US005129157A

United States Patent [19]

Wood

[11] Patent Number: 5,129,157

[45] Date of Patent: Jul. 14, 1992

[54] SPHERE SHAVER

[76] Inventor: Barry Wood, Box 12, River St., Bartlett, N.H. 03812

[21] Appl. No.: 736,225

[22] Filed: Jul. 26, 1991

[51] Int. Cl.[5] ..... B26B 21/40

[52] U.S. Cl. ..... 30/85; 30/90; D28/48

[58] Field of Search ..... 30/85, 90, 86; 16/121; 273/62; D28/48, 99

[56] References Cited

U.S. PATENT DOCUMENTS

| | | | |
|---|---|---|---|
| D. 82,453 | 11/1930 | Scully | D28/48 |
| D. 142,175 | 8/1945 | Shipley | D28/48 |
| D. 311,605 | 10/1990 | Clayton | D28/99 |
| 1,417,988 | 5/1922 | Gullborg | 30/85 |
| 1,923,439 | 8/1933 | Hukill | 30/85 |
| 2,279,324 | 4/1942 | Julien et al. | 30/85 |
| 2,750,663 | 6/1956 | Coles | 30/85 |
| 3,111,757 | 11/1963 | Dubofsky | 30/85 |
| 4,813,137 | 3/1989 | Halevy | 30/50 |

*Primary Examiner*—Frank T. Yost
*Assistant Examiner*—Hwei-Siu Payer
*Attorney, Agent, or Firm*—Robert M. Asher

[57] ABSTRACT

A shaver handle having a shaft with a rear end attached to a substantially spherical portion. The front end of the shaft is attached to a shaver head for receiving a shaver head. The shaft attaches off center to the spherical portion. The larger portion of the sphere extends below the shaft in the direction of the shaver head.

6 Claims, 2 Drawing Sheets

SPHERE SHAVER

BACKGROUND OF THE INVENTION

The present invention relates to a handle for a shaver which provides improved comfort and control.

Shaver heads and safety razor blades have undergone dramatic improvements over the decades. In all this time, little has changed with respect to the handle which holds the shaver head. The shaver handle has long been an elongated shaft.

While the standard shaver handle can be used and has been used for many years, it is far from optimal with respect to providing the user with maximal control of the shaver. In using instruments which require critical control, it is preferred that the human hand be positioned on the instrument with the fingers as close to the working portion of the instrument as possible. For example, with pens, artist tools or scalpels, the fingers are able to more accurately guide the pen point or knife when they are positioned more closely to that end.

It is an object of the present invention to provide a shaver handle which urges the forefinger naturally to the end of the handle shaft yet simultaneously permits the hand to be more relaxed while maintaining a superior grip on the shaver.

SUMMARY OF THE INVENTION

The present invention is directed to an improved shaver handle. The shaver handle of the present invention includes a shaft from which a shaver head extends at one end and a spherically-shaped portion is connected to the rear end. A major portion of the spherically-shaped portion extends below the shaft in the direction of the shaver head. A smaller portion of the spherically-shaped portion extends above the shaver shaft. The spherically-shaped portion may be formed from a sphere such as a golf ball.

The spherically-shaped portion of the shaver handle of the present invention advantageously rests comfortably within the back fingers and palm of a user's hand so that control can be maintained over the entire shaver handle. The forefinger is urged near the shaver head for close control of the shaving action. The spherically-shaped portion of the shaver handle may also be advantageously used in a shower, for instance, to suspend the shaver between two horizontal bars spaced apart a distance greater than the width of the shaver shaft but less than the width of the spherical portion. The major portion of the sphere is advantageously placed below the shaft to more comfortably fit into the back fingers and ease pressure from the palm thereby enhancing the control effected between the fingers and the shaver.

Other objects and advantages of the present invention will become apparent during the following description of the presently preferred embodiment of the invention taken in conjunction with the drawings.

DETAILED DESCRIPTION OF THE PREFERRED EMBODIMENTS

Figure 1:
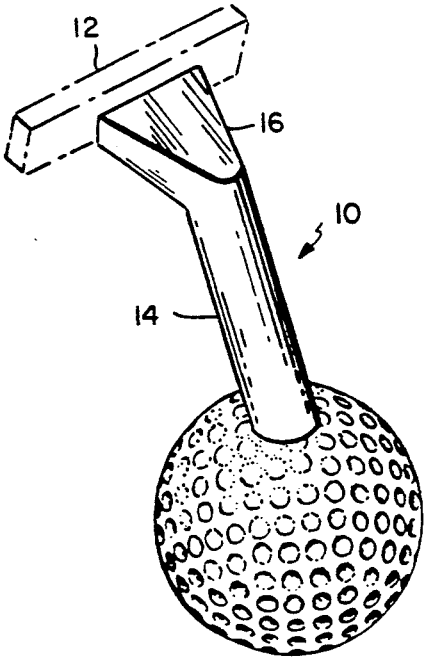
FIG. 1 is an isometric view of the shaver of the present invention.

Referring now to the drawings, a sphere shaver 10 of the present invention is illustrated in FIGS. 1–7. A typical shaver includes a shaver head 12, a shaft 14 with a bent portion 16 attached to the shaver head. The bent portion 16 provides an area on which the user's forefinger can rest during the shaving operation. However, with a conventional shaver handle, the shaft 14 is an elongated narrow member, the rear of which is difficult to control and hold when the forefinger rests near the bent portion 16.

Figure 2:
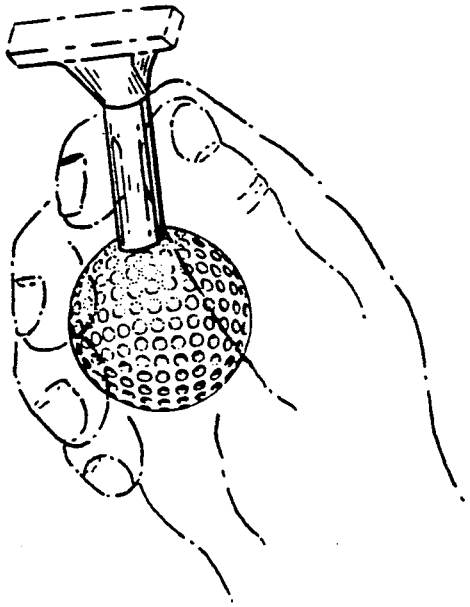
FIG. 2 is an isometric view of the shaver of the present invention within a user's hand.
Figure 3:
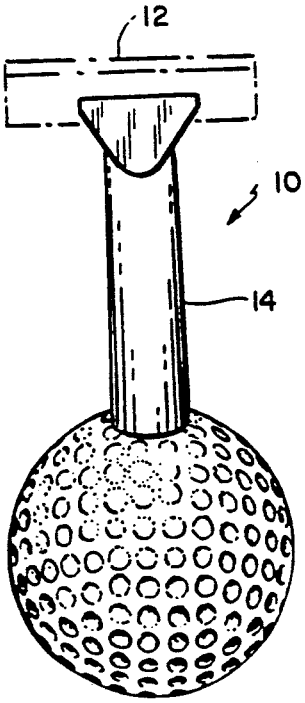
FIG. 3 is a plan view of the shaver of the present invention.
Figure 4:
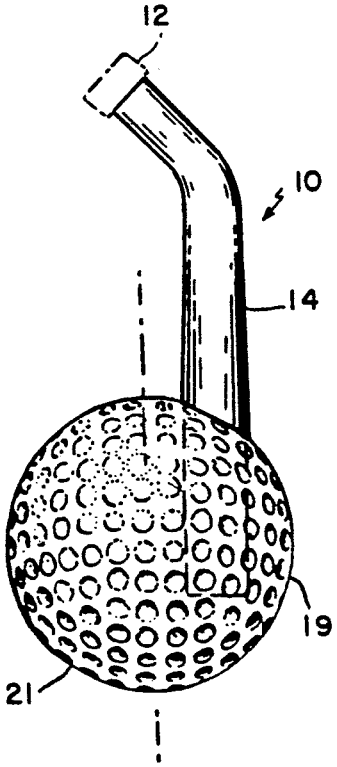
FIG. 4 is side view of the shaver of the present invention.
Figure 5:
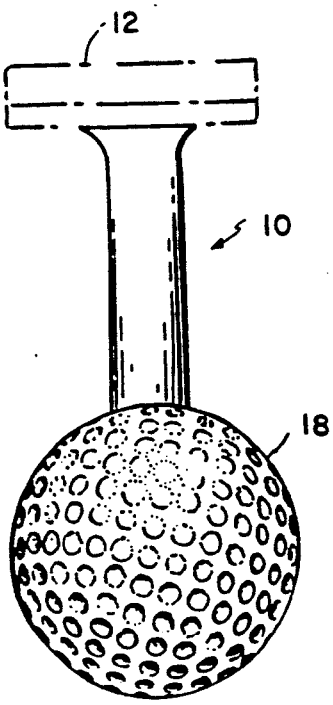
FIG. 5 is a bottom view of the shaver of the present invention.
Figure 6:
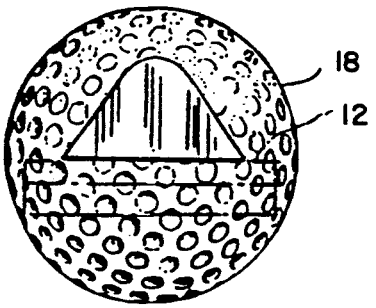
FIG. 6 is a front view of the shaver of the present invention.
Figure 7:
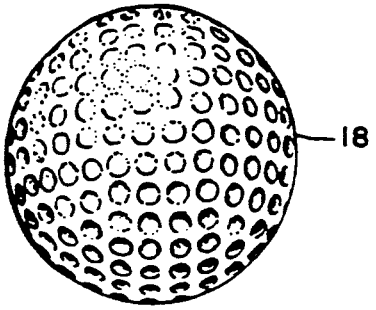
FIG. 7 is a rear view of the shaver of the present invention.

In accordance with the present invention, a spherical portion 18 is secured to the rear end of the shaft 14. As shown in FIG. 2, the spherical portion 18 conveniently fits within the palm of the user's hand. As best seen in FIG. 4, the shaft 14 extends from the spherical portion 18 off center of the sphere. A small portion 19 of the sphere extends above the shaft away from the shaving head 12. A larger major portion 21 of the sphere falls below the shaft 14 in the direction of the shaving head 12. With this arrangement, the major portion 21 of the sphere sinks comfortably into the back few fingers of the hand thereby easing the pressure on the palm and enhancing the control of the shaver. In technical geometric terms, the linear extension of the shaft 14 is parallel to a diameter through the sphere 18. It is preferred that the lower edge of the shaft 14 not enter the sphere 18 below the diameter. In other words, the shaft is inserted above the center line of the sphere. As should be apparent to those of ordinary skill in the art of handles, only the portions of the sphere 18 which come in contact with the user's hand need to be rounded and the other portions which do not contact at all may have any shape. Since the sphere 18 is encompassed by the fingers and palm of the user's hand, it should be substantially spherical in accordance with the present invention.

The preferred dimensions of the sphere shaver 10 of the present invention depends upon the size of a user's hand. It is desirable that the sphere shaver be designed so that the sphere comfortably fits within the palm and bottom fingers of the hand while the thumb and forefinger can rest near or on the bent portion 16 of the shaft 14. The preferred diameter of the sphere also depends on the size of the user's hand. The recommended sizes in accordance with the present invention would include a diameter of anywhere from 1 to 1¾ inches. The thickness of the shaft varies mostly as a matter of style. The shapes of the shaft may also vary and may be round, hexagonal, square, rectangular or almost any other shape that may be formed into a shaft. The sphere shaver of the present invention may be made in any of numerous materials that are conventionally used for shavers including high impact styrene, plastic or metal.

The sphere 18 for attachment to the shaver 10 of the present invention is preferably made with a surface that encourages an improved grip. For example, dimples may be formed in the sphere as shown in the embodiments of FIGS. 1–7. The dimples may be made concave or convex. For a more resilient grip, a thermal plastic rubber type material could be used to form the sphere 18.

There are several ways for making the sphere shaver of the present invention. For example, the shaft 14 and sphere 18 could be molded in a unitary construction. In accordance with an alternate method which provides a novelty appeal to the final product is to use an actual golf ball as the sphere 18. A hole is drilled into the golf ball above the center line of the ball. The hole is drilled to a size such that the shaft 14 of a shaver can be inserted into the hole to form a friction fit. If desired or necessary, adhesive may be included on the rear of the shaft as it is inserted into the hole in the ball to permanently hold the shaft in place.

Figure 11:
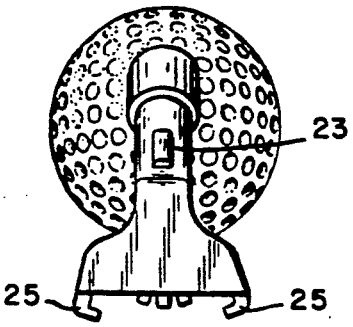
FIG. 11 is an isometric front view of an alternate embodiment of the shaver of the present invention.

As is conventional in the art of shavers, the shaver head 12 which carries the razor blade may be integral with the shaft 14. This construction is preferred when the shaver is provided as a disposable shaver. In situations where it is desired that the shaver handle be reusable, the bent portion 16 of the shaft is often provided with a mechanism for receiving and releasing a shaver head 12 as shown in FIG. 11. A button 23 on the shaft 14 is used to open or close the jaws 25 on a shaver head. The various constructions for the shaver head receiving mechanism and for the integral shaver head shafts are well known in the art and any one of them may be used with the sphere shaver handle of the present invention.

Figure 8:
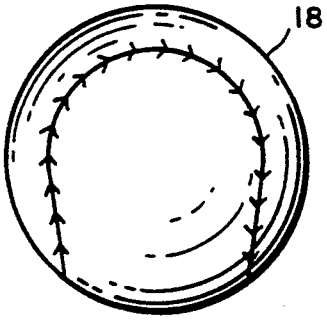
FIG. 8 is a rear view of a second embodiment of the shaver of the present invention.
Figure 9:
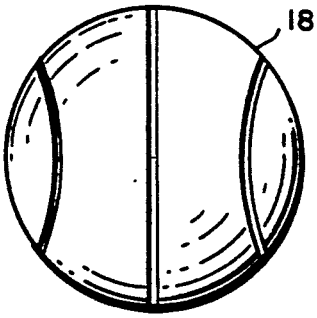
FIG. 9 is a rear view of a third embodiment of the shaver of the present invention.
Figure 10:
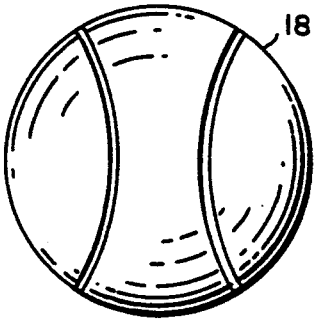
FIG. 10 is a rear view of a fourth embodiment of the shaver of the present invention.

As shown in FIGS. 8, 9 and 10, the spherical portion 18 may be made to look like any of a number of commonly used sport balls such as a baseball, basketball or tennis ball. The threads of the baseball can be embossed on the spherical portion 18 to assist in providing a grip.

The spherical handle shaver of the present invention provides an ergonomically enhanced handle for achieving better control and comfort in shaving.

Of course, it should be understood that various changes and modifications to the preferred embodiments described above will be apparent to those skilled in the art. For example, the transition between the shaver shaft and the spherical portion may be tapered so as not to be an abrupt transition as shown in the presently preferred embodiment. The shape and structure of the shaft and bent portion 16 may assume any of a number of orientations well known in the art. These and other changes can be made without departing from the spirit and scope of the invention and without diminishing its attendant advantages. It is therefore intended that such changes and modifications be covered by the following claims.

I claim:

1. A shaver comprising:

a shaft having two ends with a bent portion at one end;

a shaver head attached to the bent portion of said shaft; and a substantially spherical portion attached to the other end of said shaft and having a major portion extending below said shaft in the direction of the bent portion and a smaller portion extending above said shaft.

2. A shaver handle comprising:

a shaft having a front end and a rear end;

means for receiving a shaver head attached to the front end of said shaft at an angle to said shaft; and a sphere attached to the rear end of said shaft, said sphere having a major portion extending below said shaft in the direction of said receiving means and a smaller portion extending above said shaft.

3. A shaver comprising:

a shaft having a front end and a rear end;

means attached to the front end of said shaft, for receiving a shaver head to position a shaving edge to one side of a plane containing the rear end of said shaft;

a substantially spherical member attached to the rear end of said shaft such that more than half of said spherical member extends below said shaft on said one side of said plane containing the rear end of said shaft.

4. The shaver of claim 3 wherein the front end of said shaft includes a bent portion.

5. A method of making a shaver handle comprising the steps of:

drilling a hole off center partially into a golf ball such that a large portion is on one side of said hole and a smaller portion is on the other side of said hole;

inserting a rear end of a shaver shaft into said hole such that the larger portion of said golf ball extends from said shaft on the same side of said shaft in which a shaver head attaches.

6. The method of claim 5 further comprising the step of providing an adhesive about the rear end of said shaver shaft.

* * * * *